US005524362A

United States Patent [19]

Quandt et al.

[11] Patent Number: 5,524,362

[45] Date of Patent: Jun. 11, 1996

[54] APPARATUS AND METHOD OF USING WIRE HARNESS TO SELECT CONTROLLER MODE

[75] Inventors: William J. Quandt; Michael J. Zambrowicz, both of Ripon, Wis.

[73] Assignee: Speed Queen Company, Ripon, Wis.

[21] Appl. No.: 253,900

[22] Filed: Jun. 3, 1994

[51] Int. Cl.[6] ..... F26B 19/00

[52] U.S. Cl. ..... 34/526; 68/12.02; 439/189

[58] Field of Search ..... 34/526, 535, 546, 34/549, 550; 68/12.02; 439/189, 49, 52

[56] References Cited

U.S. PATENT DOCUMENTS 4,924,520 5/1990 Kolbert ..... 439/189

5,291,667 3/1994 Joslin et al. ..... 34/526

5,347,727 9/1994 Kim ..... 34/535

*Primary Examiner*—F. Daniel Lopez

*Attorney, Agent, or Firm*—William R. Clark

[57] ABSTRACT

An electronic controller is programmed to operate in a plurality of different modes to enable the controller to be used in a variety of different models, each requiring a different operating mode. A wire harness is used to operatively couple the controller to an electric component such as a thermistor in a clothes dryer. A connector of the wire harness has terminal pins interconnected by jumper wires in a manner uniquely corresponding to the particular model in which the wire harness is used. Logic signals are coupled through the jumper wires to the controller to identify the particular model in which the controller is installed. In response thereto, the controller selects the particular operating mode corresponding to that model.

14 Claims, 2 Drawing Sheets

APPARATUS AND METHOD OF USING WIRE HARNESS TO SELECT CONTROLLER MODE

BACKGROUND OF THE INVENTION

The field of the invention generally relates to electronic controllers, and more particularly relates to apparatus and method of selecting a particular operating mode of an electronic controller that has been preprogrammed to operate in a plurality of different modes so that the controller can be installed in any one of a plurality of different models or configurations of machines.

As is well known, many manufacturers make a variety of different models or machines. For example, an appliance manufacturer that makes clothes dryers and washers will typically make a variety of different models of each. Some models may be for commercial use, and others may be for residential use. Some models may be large tumbler dryers that operate with gas, and others may be smaller clothes dryers that are electric. Some may be basic models, while others may be top-of-the-line models that have additional features. As is well understood, each of these models or configurations typically has its own unique operating parameters or characteristics. For example, even similar commercial dryers that have the same features may have different temperature regulating set points due to differences in burners, drum sizes, thermistors, or locations of mounting the thermistor. Therefore, each model or configuration may typically require a controller uniquely programmed for its particular features, calibrations, or operating requirements.

As is also well known, it is desirable to have a common controller that can be used in a variety of different models or configurations. With such arrangement, the manufacturer can take advantage of the economy of numbers, and also can reduce the cost and complexity of maintaining manufacturing inventory and spares. In the prior art, controllers have been preprogrammed to operate in a plurality of different modes (i.e. one for each model or configuration of machine in which the controller was to be used), and then the operating mode is selected in accordance with the model in which the controller is installed. One method of selecting the particular operating mode was to mount a dip switch on the circuit board of the controller, and then set the switches to provide the controller with logic signals corresponding to the particular model in which the controller was installed. The controller's operating mode would then be determined in response to the logic signals. Another method of selecting the particular operating mode was to provide the controller with logic signals by connecting or cutting jumper wires on the circuit board. A third prior art method was to use an external connector plug with a preconfigured arrangement of jumper wires corresponding to the particular model, and connect the plug to a dedicated terminal block on the circuit board to route logic signals from the circuit board through the plug to the controller.

The above described mode selection methods had drawbacks during initial manufacture, and also during replacement of failed controllers in the field. First, it takes an assembler/technician time to determine what the dip switch setting should be, what jumper wires should be connected, or what external connector should be used. Second, assembler/technician errors can lead to an incorrect operating mode being selected for a particular model in which the controller is installed. Further, in the case of using external jumpers, a field technician may forget to attach the external connector plug to the new controller circuit board that is being installed.

SUMMARY OF THE INVENTION

An electronic controller is preprogrammed to operate in a plurality of different modes to enable the controller to be installed into any one of a plurality of different types of apparatuses or machines each requiring a different controller operating mode. For example, the difference between one operating mode for one model machine and a second operating mode for a second model is that the first may have additional features not accessible with the second model. During initial fabrication or later during field service, the controller is operatively coupled to at least one electric component using a wire transmission means such as a wire harness that has a connector that directly or indirectly interfaces to the controller. In accordance with the invention, the wire harness includes means for programming the controller to operate in the mode of the particular machine in which it is installed.

Taking a clothes dryer as an example, the wire harness may be used to interconnect the controller to a thermistor that provides status signals corresponding to the drying temperature. Preferably, the wire harness has a connector that interfaces to the controller, or more precisely, a complementary connector of a circuit board on which the controller is mounted. For this example, the wire harness connector has a plurality of terminals that are interconnected by jumper wires in a manner corresponding to the particular model in which the wire harness is installed. Logic signals on the circuit board are then routed through the complementary connector to the wire harness connector, and are then fed through the jumper wires and back to the controller through the complementary connector. Thus, the controller receives logic signals that uniquely identify the model in which the controller is installed. In response thereto, the controller selects and then enters the operating mode which corresponds to the machine in which it is installed.

With such arrangement, the assembler/technician never has to check to see which dip switch configuration, jumper wire arrangement, or dedicated connector plug is required to cause the controller to operate in the mode required for the installation. Further, there is no opportunity for the operator to make a mistake in setting dip switches, attaching or cutting jumper wires, or installing the correct connector plug. Simply stated, the signature or identifying information for the particular model is built into its particular wire harness, and connection of the wire harness to the controller is required for other reasons. For example, if the electric component is a thermistor, signals from it are required for operation of the dryer, and the assembler/technician has to connect it to the controller. Therefore, by merely connecting the wire harness in its intended manner, the controller is automatically programmed or configured to operate in the mode intended for the particular model.

BRIEF DESCRIPTION OF THE DRAWINGS

The foregoing objects and advantages will be more fully understood by reading the following Description of the Preferred Embodiment with reference to the drawings wherein.

Description of the Preferred Embodiment

Figure 1:
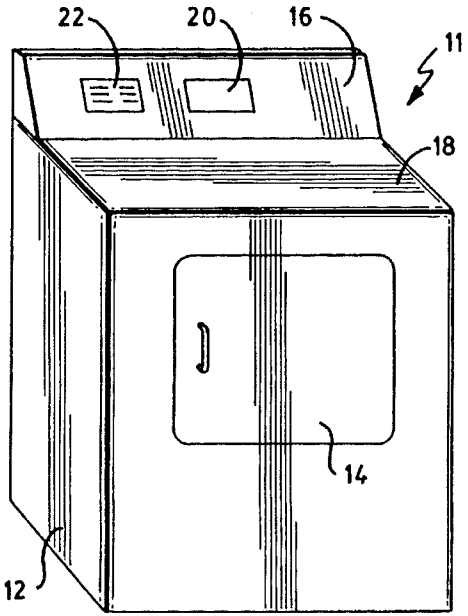
FIG. 1 is a front perspective view of a clothes dryer.

Referring to FIG. 1, residential clothes dryer 11 includes an outer cabinet 12 with a door 14. A control console 16 is mounted on the top panel 18 of outer cabinet 12, and includes a display 20 and a control panel 22. As is well known, wet clothes are inserted through door 14 and, after input commands are entered through control panel 22, clothes dryer 11 operates under the control of electronic controller 24 (FIG. 2), and heat is supplied as the drum (not shown) is rotated to tumble dry the clothes. Although a residential clothes dryer 11 is described here, the principles of the invention would be equally applicable to clothes washers, and a variety of other machines that have an electronic controller 24 to control electric devices or to receive status information from electric devices.

Figure 2:
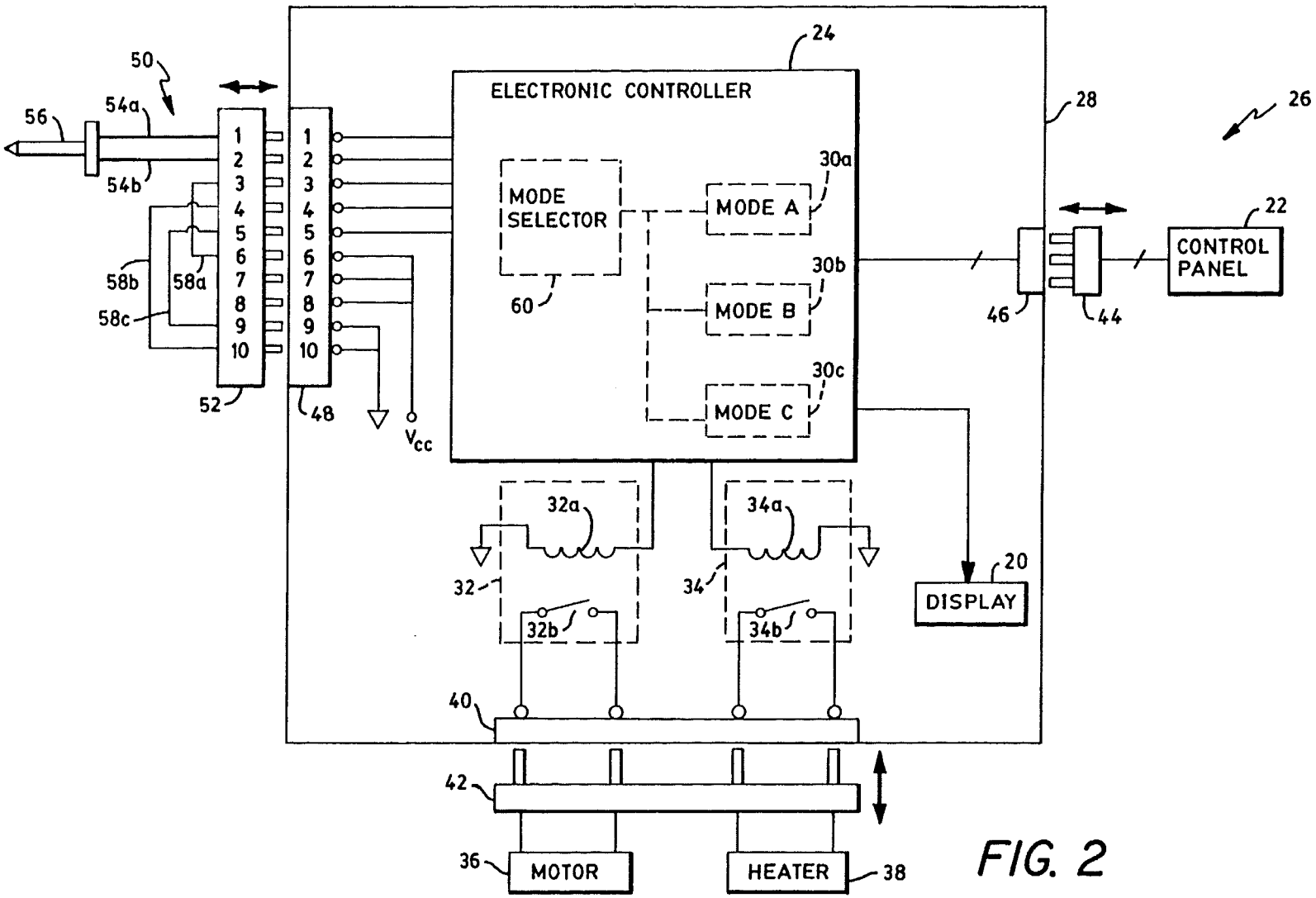
FIG. 2 is a simplified block diagram of a control including an electronic controller for the clothes dryer of FIG. 1.

Referring to FIG. 2, a simplified block diagram of the control 26 for clothes dryer 11 is shown. An electronic controller 24 is mounted on a circuit board 28. As is conventional, electronic controller 24 is pre-programmed to operate in a plurality of different modes, here modes A–C designated 30*a–c*, to enable controller 24 to be installed into any one of a plurality of different types of dryers, or other types of machines such as washers or other appliances. For example, mode A could be for a basic electric clothes dryer model that will only operate a heating cycle for a predetermined time period. Mode B, for example, could be for an electric clothes dryer model that had top-of-the-line features such as a variety of different cycles for different clothes fabrics, a cool-down cycle, and an automatic shutoff in response to humidity sensing. Mode C, for example, could be for a gas clothes dryer model. For additional examples, controller 24 could be pre-programmed to operate in additional modes so that it could be used in commercial dryers, washing machines, commercial washing machines, or a variety of other appliances or machines. It is well understood that by preprogramming an electronic controller 24 to operate in a plurality of different types or models of machines, the manufacturer can take advantage of the economy of numbers during purchasing, and also can reduce the cost and complexity of maintaining manufacturing inventory and spares.

Here, circuit board 28 is also shown to include motor relay 32 and heater relay 34, each of which includes a coil 32*a* and 34*a*, and a switch 32*b* and 34*b*. Motor relay 32 and heater relay 34 are respectively coupled to motor 36 and heater 38 through female connector 40 and connector plug 42. Input commands to electronic controller 24 are entered through control panel 22 which is coupled through connector plug 44 and female connector 46 on circuit board 28. Further, display 20 may be mounted on circuit board 28 to provide the operator with visual displays from electronic controller 24.

Circuit board 28 further includes female connector 48 here shown to have ten terminals. Terminals 1–5 provide inputs to electronic controller 24. Terminals 6–8 are connected to a logic level, here $V_{CC}$. Terminals 9 and 10 are grounded. Circuit board 28 would typically include other circuits and devices, and control 26 would typically include other electric components. However, these other circuits and components are not shown because they are not required for an understanding of the invention. For example, other electric components may include door interlock switches, temperature limiters, igniters and gas valves in the case of gas dryers, and audit devices such as coin drop sensors, coin drawer switches, etc. in the case of commercial units.

Still referring to FIG. 2, cable or wire harness 50 includes a connector plug 52 and a plurality of wires 54*a* and *b* operatively coupled to an electronic component such as, for example, thermistor 56. As is well known, thermistor 56 is located to sense the temperature at some point in the air flow path of clothes dryer 11. More particularly, electronic controller 24 applies a voltage through connector 48 and connector plug 52 to line 54*a*, and senses the voltage drop across thermistor 56 as received back on line 54*b*. In response thereto, electronic controller 24 is able to determine the temperature at the dryer location of thermistor 56, and control the cycling of heater 38 in accordance therewith. Therefore, the connection of wire harness 50 from thermistor 56 is required for the proper temperature regulation and operation of dryer 11.

In accordance with the invention, connector plug 52 serves the additional function of providing control signals to electronic controller 24 to identify the particular model of dryer 11, and in response thereto, electronic controller 24 selects the corresponding operational mode A, B, or C. More specifically, connector plug 52 has a predetermined arrangement of jumper wires 58*a–c* that interconnect terminal pins in a manner that is unique to the particular model in which cable harness 50 is used. Here, ground from terminal 10 of connector 48 is coupled to terminal pin 4 of connector plug 52 via jumper wire 58*b*. Therefore, a logical 0 is coupled from terminal 4 of connector 48 to electronic controller 24. Similarly, ground is coupled from pin 9 of connector 48 to terminal pin 5 of connector plug 52 via jumper wire 58*c*. Therefore, a logical 0 is coupled from terminal 5 of connector 48 to electronic controller 24. Further, a logical signal, here $V_{CC}$, from terminal 6 of connector 48 is coupled to terminal pin 3 of connector plug 52 via jumper wire 58*a*. Therefore, a logical 1 on terminal 3 of connector 48 is coupled to electronic controller 24. Thus, for the particular arrangement of jumper wires 58*a–c*, as shown in FIG. 2, the logical code of 100 is transmitted to the electronic controller 24 from terminals 3-4-5 of connector 48.

Figure 3:
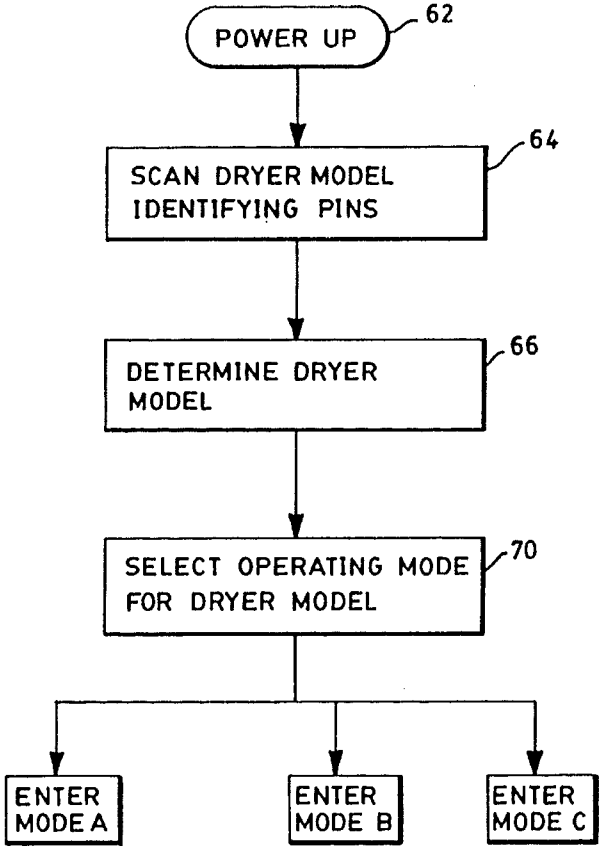
FIG. 3 is a simplified flow diagram showing the operation of the electronic controller of FIG. 2.

Electronic controller 24 has software which, in response to the model identifying code provided by wire harness 50, functions as mode selector 60 to select the suitable operating mode A, B, or C for the particular model of dryer. More specifically, referring to FIG. 3, a simplified flow diagram of a portion of the software of electronic controller 24 is shown. Upon any initial POWER UP 62 of mode selector 60, electronic controller 24 will SCAN DRYER MODEL IDENTIFYING PINS 64, here shown as pins 3-4-5 of connector plug 52 which are coupled through respective terminals 3-4-5 of connector 48. Next, electronic controller 24 will DETERMINE DRYER MODEL 66 based on the unique identifying code from cable harness 50. Once the dryer model is identified, electronic controller 24 will SELECT OPERATING MODE FOR DRYER MODEL 70. That is, the electronic controller 24 will ENTER MODE A, ENTER MODE B, or ENTER MODE C as suitably appropriate for the particular dryer model.

Figure 4A:
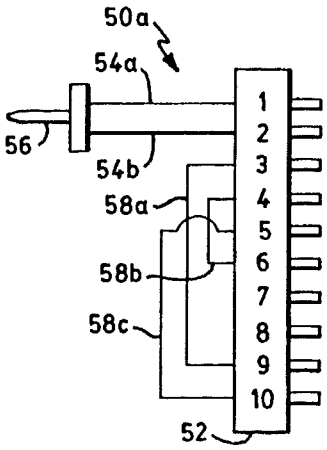
FIG. 4A is a view of the wire harness of FIG. 2 configured to identify a different clothes dryer model.
Figure 4B:
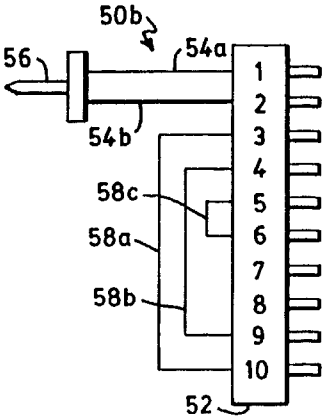
FIG. 4B is a view of the wire harness of FIG. 2 configured to identify still another clothes dryer model.

Referring to FIG. 4A, a wire harness 50*a* is shown for a different model of dryer requiring different operating parameters or characteristics. The parts are the same, except that the jumper wires 58*a–c* are connected between different pairs of terminal pins. More specifically, the ground or logical 0 on pin 10 is coupled to pin 5. The ground, or logical 0, on pin 9 is coupled to pin 3. The $V_{CC}$ voltage, or logical 1 on pin 6 is coupled to pin 4. Thus, a logical code of 010 is coupled to electronic controller 24 to identify the particular model of dryer for which wire harness 50*a* is used. Similarly, referring to FIG. 4B, ground on pin 10 is coupled to pin 3, ground on pin 9 is coupled to pin 4, and $V_{CC}$ or logical 1 on pin 6 is coupled to pin 5. Thus, wire harness 50*c* would transmit a logical of 001 to electronic controller 24 to identify the particular dryer model in which electronic controller 24 was installed. As discussed before, these codes would be interpreted by electronic controller 24 to program or configure electronic controller 24 to the proper mode of operation for the particular model in which controller 24 is installed.

In summary, electronic controller 24 is preprogrammed to operate in a plurality of different modes, here modes A–C, so that controller 24 can be used in a variety of different models or machines, each requiring its own unique operating mode due to its own unique operating characteristics. In order to eliminate assembler/technician errors and to reduce service and fabrication time in determining and selecting the proper mode, wire harness 50 has jumper wires 58*a–c* preconfigured in accordance with the particular model or machine in which the wire harness 50 is used. Logic signals are routed through the jumper wires 58*a–c* to provide the controller 24 with model identifying signals which function to control or program the operating mode of the controller 24. That is, the controller 24 is automatically caused to operate in the particular mode required for that installation of the controller 24. The wire harness 50 is an integral part of the machine and required for proper operation. Therefore, its connection to the controller 24 would not generally be a step that would inadvertently be overlooked.

This concludes the description of the preferred embodiment. However, a reading of it by one or ordinary skill in the art will bring to mind many alterations and modifications that do not depart from the spirit and scope of the invention. For example, in the embodiment described herein, thermistor 56 was operatively coupled through the wire harness 50; however, it should be understood that a variety of other electric components could be operatively coupled through wire harness 50. Also, three mode control or model identifying signals were described; however, with three bits, eight different modes could be specified, and a different number of bits could be used. Therefore, it is intended that the invention be limited only by the appended claims.

What is claimed is:

1. An apparatus comprising:

at least one electric component;

an electronic controller preprogrammed to operate in a plurality of different modes to enable said controller to be installed into any one of a plurality of different types of apparatuses each requiring a different controller operating mode;

wire transmission means for operatively coupling said electric component and said controller, said wire transmission means comprising means for programming said controller to operate in a predetermined one of said modes corresponding to said apparatus wherein said wire transmission means comprises a plurality of wires connected to an interface, and said programming means comprises at least one jumper wire interconnected between respective terminal pins of said interface to feed a mode control signal to said controller; and a circuit board on which said controller is mounted, said circuit board having a complementary connector adapted to mate with said interface of said wire transmission means, said circuit board further having a logic level signal source connected through said complementary connector and said interface to said at least one jumper wire, and back through said interface and said complementary connector to said controller.

2. The apparatus recited in claim 1 wherein said interface comprises a connector plug having jumper wires interconnecting predetermined terminal pins in accordance with the type of said apparatus to provide said controller with control signals identifying said type of said apparatus.

3. The apparatus recited in claim 2 wherein said electric component comprises means for providing a status signal to said controller.

4. The apparatus recited in claim 1 wherein interconnection of said wire transmission means between said electric component and said controller is necessary for operation of said apparatus.

5. A laundry machine comprising:

an electronic controller preprogrammed to operate in a plurality of different modes each corresponding to a different laundry machine model wherein said laundry machine is one of said models;

at least one electric component; and a wire harness operatively coupled between said electronic controller and said electric component, said wire harness comprising means for providing said electronic controller with a control signal to cause said electronic controller to operate in an operating mode corresponding to said laundry machine wherein said wire harness comprises at least one wire and an interface to said electronic controller, wherein said interface comprises a connector having a plurality of terminals wherein predetermined ones of said terminals are interconnected in accordance with the particular model of said laundry machine.

6. The laundry machine recited in claim 5 further comprising a circuit board on which said electronic controller is mounted, said circuit board comprising means for providing at least one logic signal to at least one of said interconnected terminals and said controller comprises means for detecting the presence of said at least one logic signal at an interconnected terminal.

7. The laundry machine recited in claim 5 wherein said electric component comprises means for providing a status signal for said controller.

8. The laundry machine recited in claim 7 wherein said electric component comprises a thermistor.

9. The laundry machine recited in claim 7 wherein said status signal is necessary for operation of said laundry machine.

10. A clothes dryer comprising:

a circuit board comprising a source of a logic signal and a connector having at plurality of terminals wherein said logic signal source is connected to at least one of said terminals of said circuit board connector;

an electronic controller mounted on said circuit board, said controller being programmed to operate in a plurality of different operating modes to enable said controller to be installed in a plurality of different clothes dryer models each requiring a different operating mode;

an electric clothes dryer component;

a wire harness operatively coupled between said electric clothes dryer component and said circuit board connector, said wire harness having a connector with a plurality of terminals wherein predetermined ones of said terminals are interconnected in accordance with the model of said clothes dryer, said wire harness connector being mated with said circuit board connector wherein said logic signal is coupled to said wire harness connector, to at least another one of said wire harness connector terminals in accordance with the model of said clothes dryer, and back to a corresponding terminal of said circuit board connector; and said controller being connected to receive said logic signal from said corresponding terminal of said circuit board connector and comprising means responsive to said logic signal for selecting an operating mode corresponding to said model of said clothes dryer.

11. The clothes dryer recited in claim 10 wherein said electric clothes dryer component comprises means for providing a status signal to said controller.

12. The clothes dryer recited in claim 11 wherein said electric clothes dryer component comprises means for providing a temperature signal.

13. The clothes dryer recited in claim 12 wherein said temperature signal providing means comprises a thermistor.

14. In a machine of a particular type, a method of selecting an operating mode of an electronic controller programmed to operate in a plurality of different modes to enable installation of the controller into a plurality of different types of machines, comprising the steps of:

operatively coupling a wire harness between an electric component of the machine and the controller to transfer an electrical signal between the component and the controller; and providing a machine type identifying control signal from the wire harness to the controller to cause the controller to select the operating mode of the particular machine from the plurality of operating modes wherein said wire harness comprises at least one wire attached to a connector having predetermined terminals interconnected in accordance with the particular type of said machine, and said identifying control signal providing step comprises a step of feeding logic signals through said terminals to said controller, and wherein said controller is mounted to a circuit board having a complementary connector mated to said wire harness connector, and said logic feeding signal step comprises a step of routing said logic signals from said circuit board to said wire harness connector through said complementary connector and back to said complementary connector and controller through said interconnected terminals of said wire harness.

* * * * *